US009010589B2

(12) United States Patent
Thurman et al.

(10) Patent No.: US 9,010,589 B2
(45) Date of Patent: Apr. 21, 2015

(54) SELF SEALING BAG IN BOX CAP ASSEMBLY

(75) Inventors: Charles Thurman, Northlake, IL (US); James J. Arch, Berkley, IL (US); David Bellmore, Aurora, IL (US)

(73) Assignee: Scholle Corporation, Irvine, CA (US)

( * ) Notice: Subject to any disclaimer, the term of this patent is extended or adjusted under 35 U.S.C. 154(b) by 1023 days.

(21) Appl. No.: 13/100,271

(22) Filed: May 3, 2011

(65) Prior Publication Data

US 2011/0272405 A1 Nov. 10, 2011

Related U.S. Application Data

(63) Continuation-in-part of application No. 12/589,368, filed on Oct. 22, 2009, now Pat. No. 8,448,799.

(60) Provisional application No. 61/196,969, filed on Oct. 22, 2008.

(51) Int. Cl.

| | |
|---|---|
| ***B65D 5/72*** | (2006.01) |
| ***B65D 25/40*** | (2006.01) |
| ***B65D 35/38*** | (2006.01) |
| ***B65D 39/00*** | (2006.01) |
| ***B65D 41/00*** | (2006.01) |
| ***B65D 43/00*** | (2006.01) |
| ***B65D 47/00*** | (2006.01) |
| ***B65D 51/00*** | (2006.01) |
| ***B65D 53/00*** | (2006.01) |
| ***B65D 47/08*** | (2006.01) |
| ***B65D 75/58*** | (2006.01) |
| ***B65D 47/20*** | (2006.01) |

(52) U.S. Cl.

CPC ..... *B65D 47/0838* (2013.01); *B65D 47/0842* (2013.01); *B65D 75/5877* (2013.01); *B65D 2231/022* (2013.01); *B65D 47/2037* (2013.01)

(58) Field of Classification Search

CPC ..... B65D 47/04; B65D 47/06; B65D 47/20; B65D 47/2031; B65D 47/0804; B65D 47/0823; B65D 2547/063; B65D 2547/066

USPC ..... 220/229, 366.1; 215/247, 253, 341, 215/378; 222/490, 494

See application file for complete search history.

(56) References Cited

U.S. PATENT DOCUMENTS 5,271,531 A * 12/1993 Rohr et al. ..... 222/212
5,409,114 A * 4/1995 Myers et al. ..... 206/394

(Continued)

*Primary Examiner* — Fenn Mathew
*Assistant Examiner* — Andrew T Kirsch
(74) *Attorney, Agent, or Firm* — The Watson I.P. Group, PLC; Jovan N. Jovanovic; Vladan M. Vasiljevic

(57) ABSTRACT

A cap assembly having a body, a sealing membrane and a retaining ring. A spout engagement channel is positioned on the bottom surface of the body. An opening extends through the body and includes a recessed circumferential channel and a membrane engaging flange. The sealing membrane covers the opening and includes a body engaging flange and a pierceable surface. The sealing membrane is positioned upon the membrane engaging flange so that the body engaging flange and the membrane engaging flange are in overlying engagement. The retaining ring includes a tab, a sealing membrane engagement surface and an inner wall structure. The retaining ring is positioned in overlying engagement with the sealing membrane. Extension of the tab into the recessed circumferential channel releasably maintains said overlying engagement and biases the retaining ring against the membrane. The inner wall structure of the retaining ring extends radially inward beyond the membrane engaging flange.

17 Claims, 7 Drawing Sheets

(56) References Cited

U.S. PATENT DOCUMENTS 5,842,618 A * 12/1998 Julemont et al. ..... 222/490
6,371,340 B1 * 4/2002 Pateman et al. ..... 222/494
6,726,063 B2 * 4/2004 Stull et al. ..... 222/212

* cited by examiner

-PRIOR ART-

SELF SEALING BAG IN BOX CAP ASSEMBLY

CROSS-REFERENCE TO RELATED APPLICATION

This is a continuation in part of U.S. patent application Ser. No. 12/589,368 filed Oct. 22, 2009, now U.S. Pat. No. 8,448,799 entitled "Self Sealing Bag in Box Cap Assembly," which claims priority from U.S. patent application Ser. No. 61/196,969, filed Oct. 22, 2008, entitled "Self Sealing Bag in Box Cap Assembly", the entire disclosure of which is hereby incorporated by reference. This application is also related to U.S. patent application Ser. No. 29/282,152 filed Jan. 13, 2011, entitled "Self Sealing Bag in Box Cap Assembly", the entire disclosure of which is hereby incorporated by reference.

BACKGROUND OF THE DISCLOSURE

1. Field of the Disclosure

The disclosure relates in general to a cap assembly, and more particularly, to a self sealing bag in box cap assembly. Such a cap assembly is used in association with the dispensing of flowable material from a bag.

2. Background Art

Self sealing bags have become increasingly useful, especially in the food packaging industry. One current system utilizes a flexible bag having a spout to which a Sentry cap available from Scholle Corporation is affixed. A separate hose is provided which has at a first end a probe and at a second end a connector available from Erie Plastics with a flexible membrane. One such membrane is available from LMS of Illinois. The probe is inserted into the opening of the Sentry cap and the other end is affixed to a distribution hose so that flowable material can be withdrawn from the flexible bag through the Sentry Cap and to the distribution hose. One such system is shown in FIG. 1 referred to generally as 200. Several different embodiments of such a cap are shown in U.S. Pat. No. 7,387,220 issued to Verespej et al and assigned to Scholle Corporation and U.S. Pat. No. 7,357,277 issued to Verespej et al and assigned to Scholle Corporation. Both of these patents are incorporated by reference herein, in their entirety.

Among other drawbacks, such a system requires many separate components which increase the cost of use of such a system. Additionally, with such a system, many connections are utilized, each of which is susceptible to failure. Further still, such sealing membranes are prone to damage during the insertion of the probe therein, and there are drawbacks associated with the membrane configurations themselves.

It is an object of the present disclosure to provide an improved self sealing bag in box system with an improved cap assembly.

It is another object of the disclosure to provide an improved sealing membrane which effectively seals and which is resistant to degradation or destruction by the insertion or removal of the probe.

These objects as well as other objects of the present invention will become apparent in light of the present specification, claims, and drawings.

SUMMARY OF THE DISCLOSURE

The disclosure is directed to a cap assembly comprising a body, a sealing membrane and a retaining ring. The body includes a top surface and a bottom surface. The spout engagement channel is positioned on the bottom surface. An opening extends through the channel. The opening includes a recessed circumferential channel. A membrane engaging flange is positioned proximate the recessed circumferential channel. The sealing membrane covers the opening and includes a body attachment flange. A valve body forming a substantially cup shaped configuration extends inwardly from the attachment flange and in a depending direction toward the bottom surface of the body. The valve body includes a sidewall structure with an inner surface and an outer surface, and a base wall structure spanning the inner surface of the sidewall structure. The inner surface is angled inwardly towards the bottom surface of the body so that the thickness of the sidewall structure increases away from an upper end thereof. The base wall structure has a valve opening extending therethrough, and a connector region coupling the upper end of the valve body to the body attachment flange. The sealing membrane is positioned upon the membrane engaging flange so that the body engaging flange and the membrane engaging flange are in overlying engagement. The retaining ring includes a tab, a sealing membrane engagement surface and an inner wall structure opposite the sealing membrane engagement surface. The retaining ring is positioned with the sealing membrane engagement surface in overlying engagement with the sealing membrane. Upon extension of the tab into the recessed circumferential channel of the body releasably said overlying engagement is maintained and the retaining ring is biased against the membrane.

In a preferred embodiment, the inner wall structure of the retaining ring extends radially inward beyond the body attachment flange of the sealing membrane.

In another preferred embodiment, the inner wall structure of the retaining ring extends radially inward beyond the connector region of the sealing membrane.

In a preferred embodiment, the inner surface of the sidewall structure further includes an inward protrusion extending therealong.

In yet another preferred embodiment, the sealing membrane comprises a substantially circular configuration, matching the opening of the body. In such an embodiment, the body attachment flange has a substantially annular configuration with a substantially triangular cross-sectional configuration.

In another preferred embodiment, the inner surface of the sidewall structure further includes an inward protrusion extending therealong. The inward protrusion has a substantially hemispherical cross-sectional configuration.

In another preferred embodiment, the outer surface of the sidewall structure is substantially uniformly spaced apart from a portion of the opening of the body that is substantially corresponding thereto.

In another preferred embodiment, the valve opening comprises a substantially snowflake like pattern of slits extending therethrough.

In a preferred embodiment, the base wall is substantially planar.

In another preferred embodiment, the ring further includes an inwardly sloping protective flange which terminates with a substantially planar wall which is substantially parallel to a longitudinal axis of the opening.

Preferably, a cap is removably coupled to the body. The cap precludes access to the opening and the sealing membrane when the cap assembly is in operable engagement with a bag.

In another preferred embodiment, the inner wall structure of the retaining ring includes an inwardly sloped surface.

Preferably, the inwardly sloped surface is inclined at an acute angle, and terminates with a substantially planar wall.

In another preferred embodiment, the recessed circumferential groove is spaced apart from a top surface of the cap.

In a preferred embodiment, the opening further includes an upper inwardly sloping wall portion positioned above the recessed circumferential channel.

Preferably, the opening further includes a lower inwardly sloping wall portion positioned below the membrane.

BRIEF DESCRIPTION OF THE DRAWINGS

The disclosure will now be described with reference to the drawings wherein.

DETAILED DESCRIPTION OF THE DISCLOSURE

Figure 1:
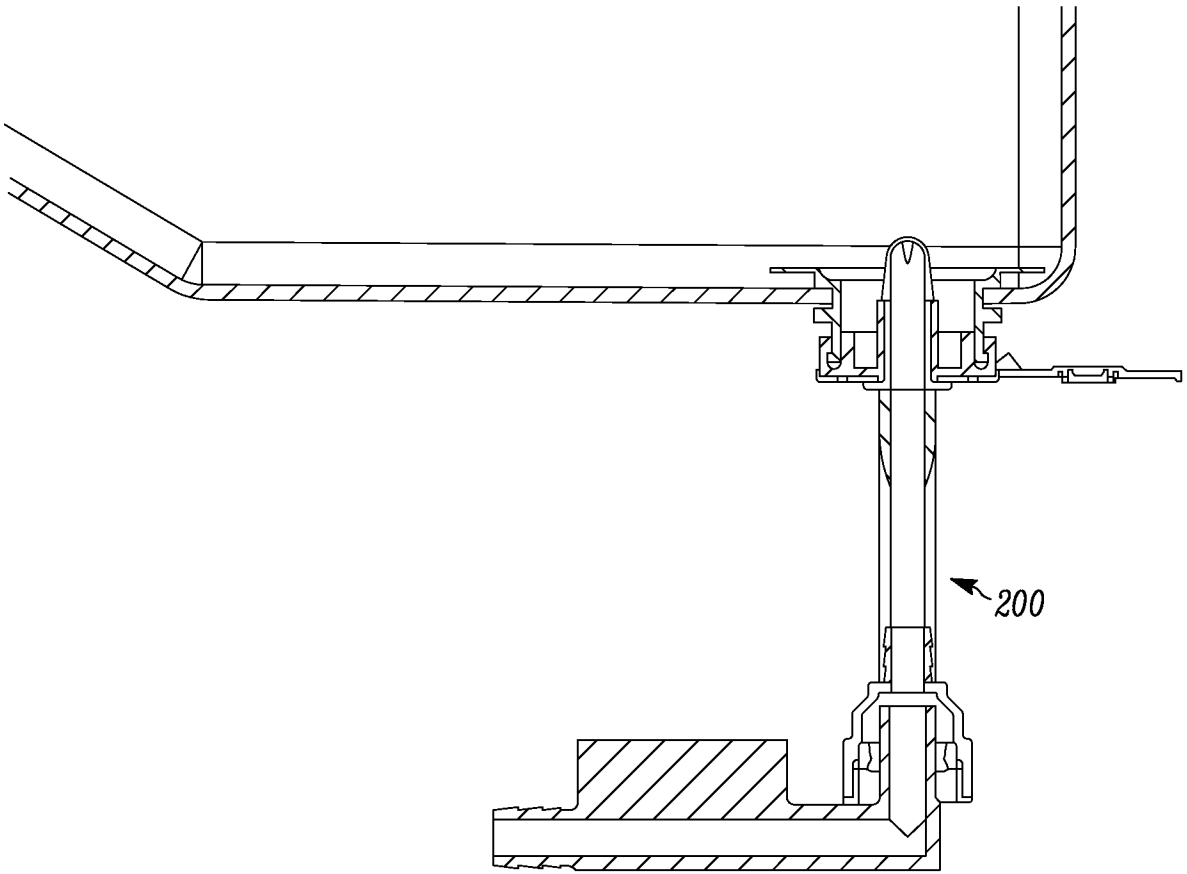
FIG. 1 of the drawings is a prior art system.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Figure 2:
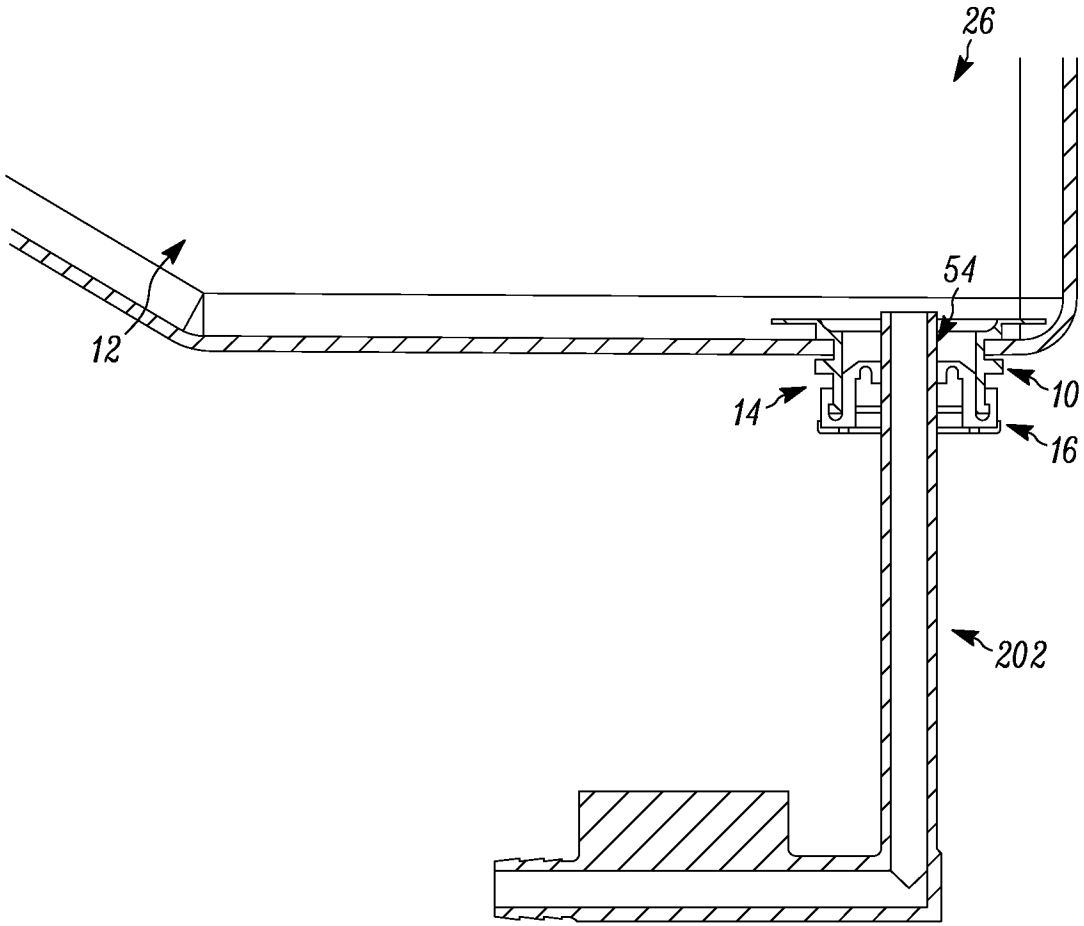
FIG. 2 of the drawings is a system of dispensing utilizing the self sealing bag in box cap assembly of the present disclosure.

Referring now to the Figures associated with the present disclosure, and in particular to FIG. 2, container assembly 10 includes container body 12, spout 14 and cap assembly 16. Container body 12 comprises a plurality of panels and a plurality of seals. The panels and seals cooperate to define cavity 26. Of course, the invention is not limited to any particular number of panels and/or seals, or, a container body having any particular geometric configuration. For example, the container body may comprise a pillow-type container, or may comprise a gusseted container, among others. Such container assemblies are commonly utilized with a number of different types of flowable material. For example, syrups, purees, smoothies, pastes and other materials may be utilized in association with the container. The disclosure is certainly not limited to any particular flowable material.

Figure 3:
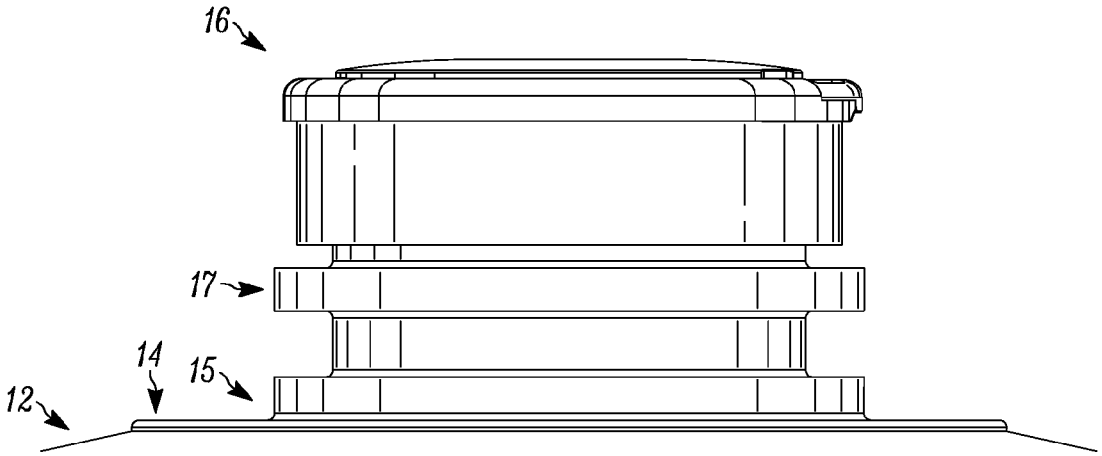
FIG. 3 of the drawings is a side elevational view of the spout and the cap assembly of the dispensing system of the present disclosure.

An exemplary spout 14 is shown in FIG. 3 as comprising a body, base flange 15, and grasping flange 17. The base flange extends from the body. The base flange is larger than the opening on the bag, such that the panel surrounding the opening is welded to the base flange, providing a substantially fluid tight connection. The grasping flange 17 may comprise one of what may be a plurality of separate flanges which are configured for grasping and retaining of the fitment by filling equipment, and for retention by other containers in which the container assembly is positioned (i.e., retention of a box of a bag in box container assembly). The fitment may comprise a HDPE material, or a polypropylene material, among others. Again, the invention is not limited to use with any particular spout, or any particular configuration of a spout, or with a spout formed from any particular material.

Figure 4:
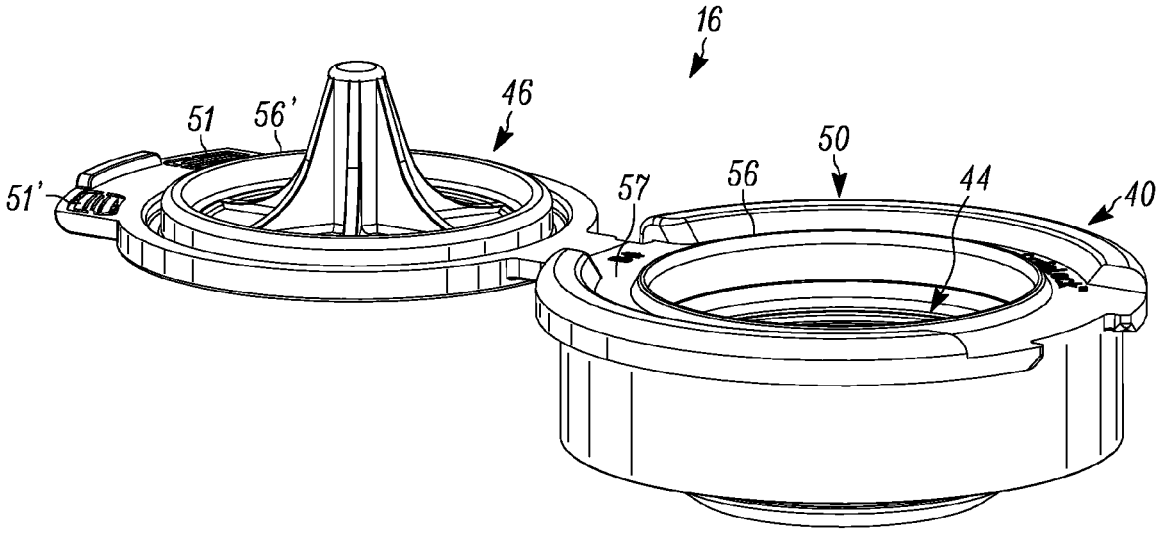
FIG. 4 of the drawings is a perspective view of the cap assembly of the dispensing system of the present disclosure, showing, in particular, the cap assembly in an open configuration.
Figure 5:
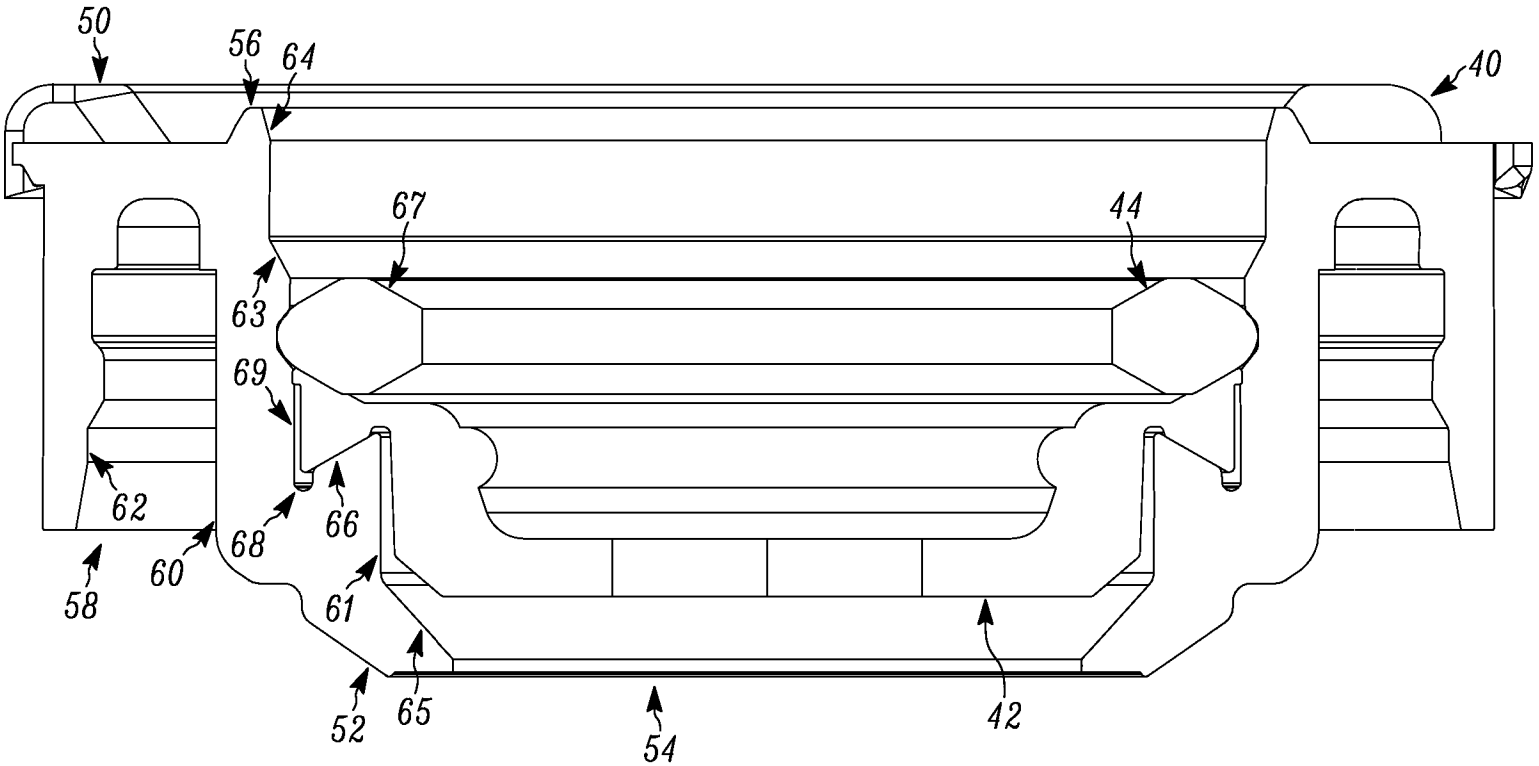
FIG. 5 of the drawings is a cross-sectional view of the cap assembly of the dispensing system of the present disclosure, with the omission of the cap 46, showing, in particular, the placement of the sealing membrane and the retaining ring.

An exemplary cap assembly 16 is shown in each of FIGS. 4 and 5 as comprising base 40, sealing membrane 42 (FIG. 5 only), retaining ring 44 (FIG. 5) and cap/seal 46. The body 40 includes top surface 50, bottom surface 52 and opening 54. Generally, the body and the cap may be integrally molded (much like the Sentry product sold by Scholle Corporation). The sealing membrane and the retaining ring comprise separate elements which are coupled to the base. In certain embodiments, the cap may be omitted, and a membrane seal (formed from a foil or a polymer film) can be sealingly engaged with the top surface 50 of the body. This membrane is frangible and pierced prior to or simultaneous with insertion of a drain or probe into the opening 54 of the cap assembly. Typically, the base and cap, as well as the ring are formed from a polymer, such as HDPE, or polypropylene, although other materials are likewise contemplated.

With reference to FIG. 4, the top surface 50 includes circumferential cap sealing flange 56. The circumferential cap sealing flange 56 is typically employed when cap 46 is utilized. The cap 46 includes a similar sealing flange 56' which together with the cap sealing flange 56 provides a hermetic seal when engaged. In embodiments wherein a membrane seal is utilized, the sealing flange 56 can be omitted, and the membrane seal can be sealed against the circumferential sealing surface 57 which is outboard of the location of the cap sealing flange. Additionally, tamper evident structures, such as structures 51, 51' may be provided on the cap.

With reference to FIG. 5, the bottom surface 52 of the body 40 further includes spout engagement channel 58 which is configured to engage and retain a spout, such as spout 14 of the container 10. Generally, the seal is hermetic and results from the elastic deformation of each of the spout and the channel 58. The channel 58 is defined by inner circumferential flange 60 and outer circumferential flange 62 which are concentrically positioned with respect to the opening and with respect to each other. It will be understood that in many embodiments, the inner circumferential flange 60 forms the outer wall of the opening 54. In other embodiments, the outer wall of the opening may comprise a separate structure that is spaced apart from (but preferably concentric with) the circumferential flanges 60, 62.

Figure 6:
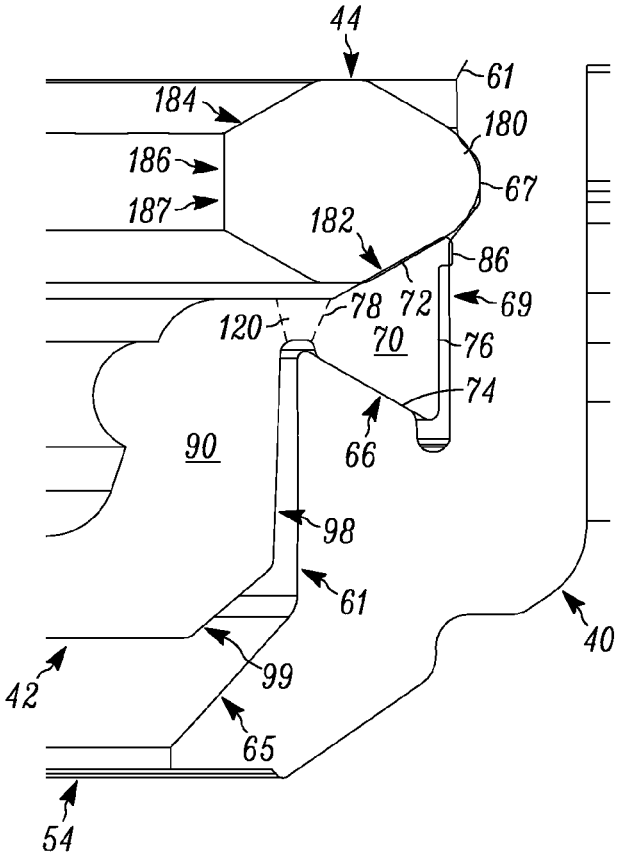
FIG. 6 of the drawings is a partial cross-sectional view of the cap assembly of the dispensing system of the present disclosure, showing, in particular, the placement of the sealing membrane and the retaining ring.

With reference to FIGS. 5 and 6, opening 54 is shown in FIG. 5 as including (i.e., being defined by) inner surface 64 and membrane engaging flange 66 positioned at the lower end thereof. The inner surface 64 includes a recessed circumferential channel 67, a base channel 68 and a membrane engaging surface between the recessed circumferential channel 67 and the base channel 68. In the embodiment shown, the membrane engaging flange 66 is angled so that the surface of the flange is at an acute angle with the membrane engagement surface 69. Of course, this is exemplary and not to be deemed limiting. Additionally, an inwardly sloping guide wall portion 63 may be circumferentially disposed above the recessed circumferential channel so as to direct a probe inwardly toward the membrane above the position of the retaining ring when the retaining ring is in its operable position. Similarly, an upper inwardly sloping lower guide wall portion 65 extends from a depending region 61 of the membrane engaging flange 66 and directs the membrane, and in turn, the probe toward the center of the opening. It has been found that such a portion 65 greatly limits damage to the membrane caused by the probe entering in a less than ideal location.

Figure 7:
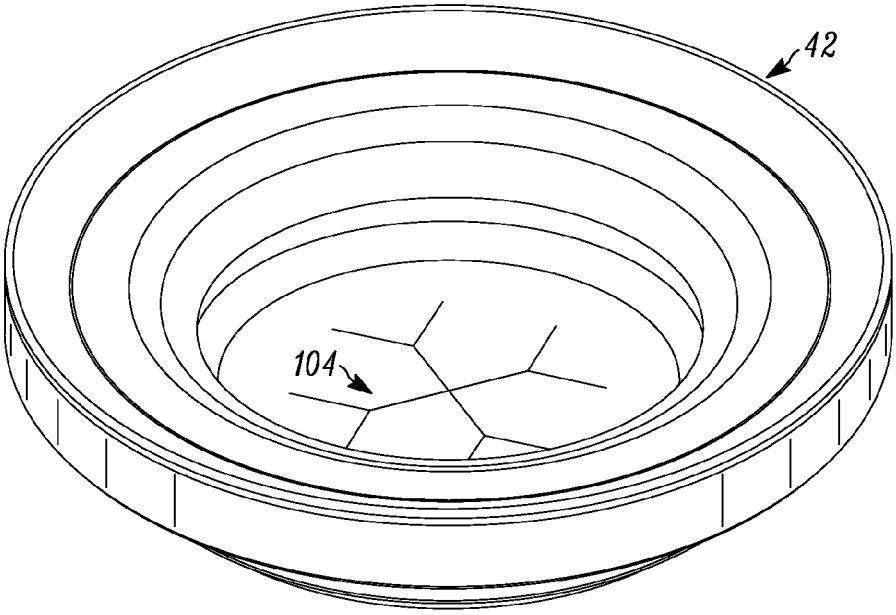
FIG. 7 of the drawings is a perspective view of the sealing membrane of the present disclosure, showing, in particular, the valve opening.
Figure 8:
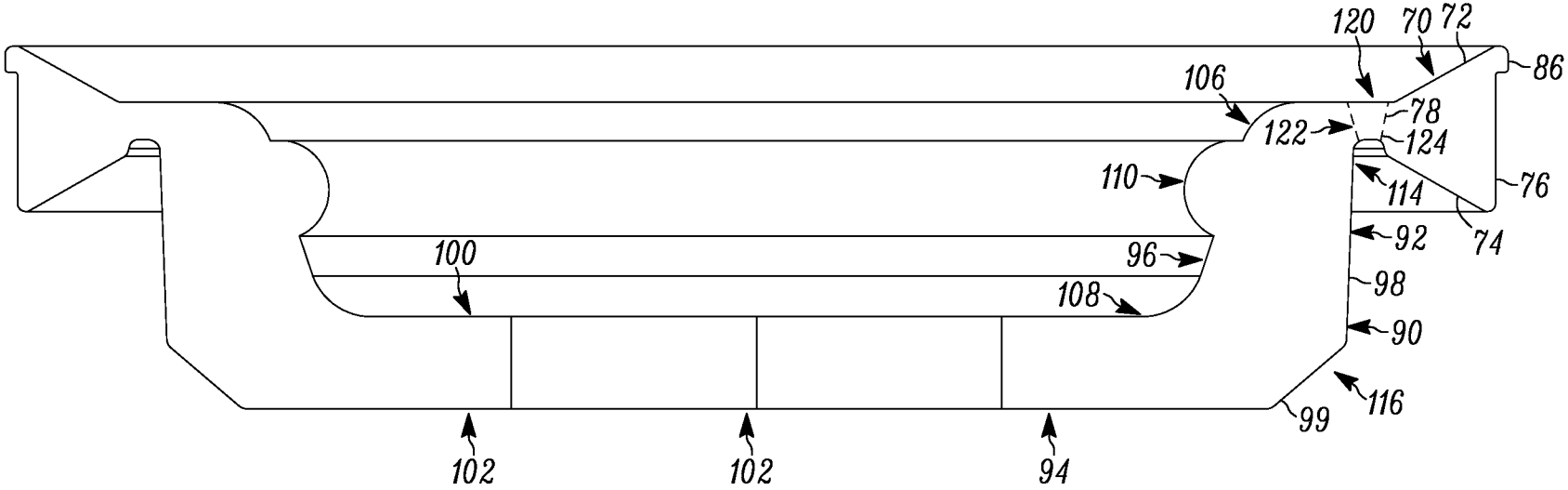
FIG. 8 of the drawings is a cross-sectional view of the sealing membrane of the present disclosure.
Figure 9:
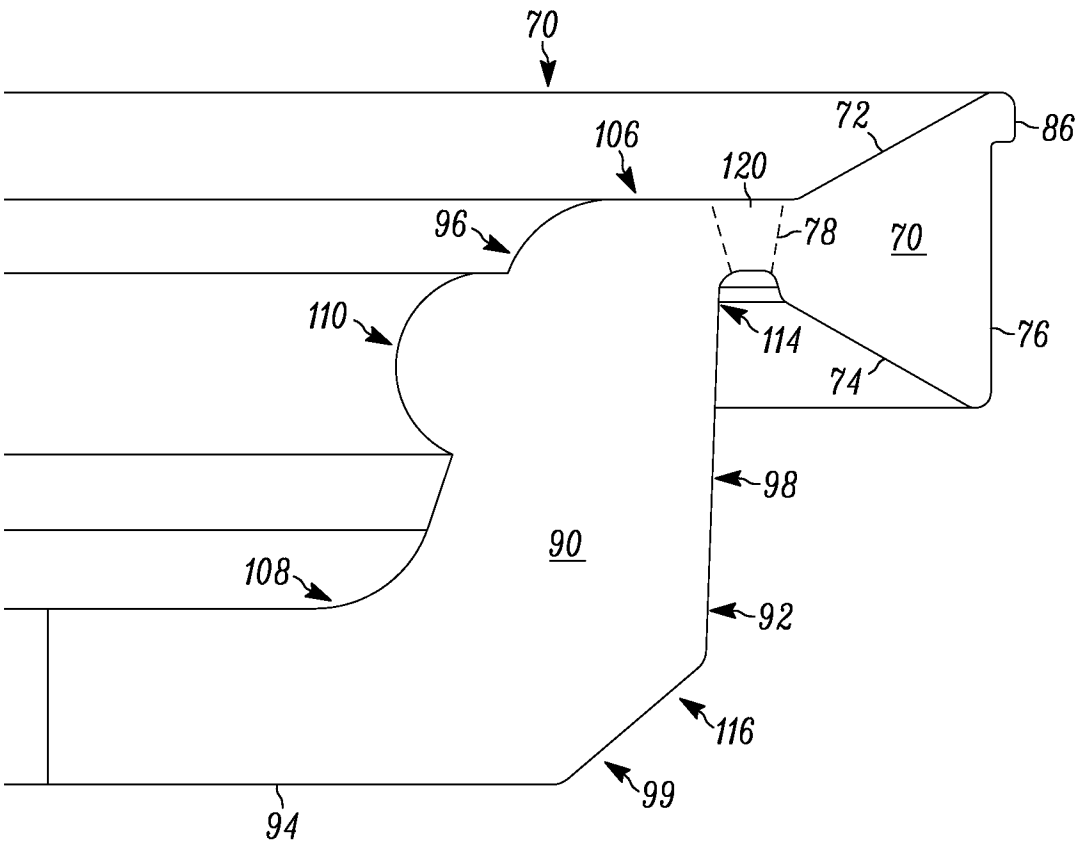
FIG. 9 of the drawings is a partial cross-sectional view of the sealing membrane of the present disclosure, showing, in particular, the features of the body attachment flange, the connector region and the sidewall structure of the valve body.

With reference to FIGS. 7 through 9, sealing membrane 42 is shown as comprising body attachment flange 70, valve body 90 and connector region 120. The sealing membrane comprises a silicone polymer material, although other materials are likewise contemplated for use. Such materials include, but are not limited to natural and synthetic rubbers and low durometer polymers. Generally the sealing membrane has a generally circular circumferential configuration with the body attachment flange having an annular configuration. Of course, the outer perimeter configuration is not limited to a substantially circular configuration, and other shapes are contemplated for use.

With further reference to FIG. 6, the body attachment flange 70 comprises upper seal surface 72, lower seal surface 74 outer seal surface 76 and connector coupling interface 78. The body attachment flange has a substantially triangular cross-sectional configuration. In such a configuration the outer seal surface 76 is substantially vertically oriented, and includes an upper flange 86 which extends outwardly from the upper end thereof. The connector coupling interface 78 is spaced apart from, and inward of, the outer seal surface 76. The upper seal surface 72 extends across the upper ends of the outer seal surface 72 and the connector coupling interface 78. The lower seal surface 74 extends across the lower ends of the outer seal surface 72 and the connector coupling interface 78.

As will be explained, the outer seal surface 76 seals against membrane engagement surface 69. Additionally, the lower seal surface 74 sealingly engages membrane engaging flange 66. Finally, the upper seal surface sealingly engages the sealing membrane engaging surface 182 of the retaining ring 44. The ring compresses the body attachment flange 70 against the membrane engaging flange 66 and the natural resilience of the material forms a substantially fluid tight seal.

With reference to FIGS. 8 and 9, the valve body 90 is shown as comprising a substantially cup-like shaped member. The valve body includes sidewall structure 92 and base wall structure 94. In the embodiment shown, the sidewall structure 92 comprises a substantially annular hoop-like member with the base wall structure 94 spanning within the confines of the sidewall structure.

The sidewall structure 92 comprises inner surface 96 and outer surface 98. The inner surface includes upper end 106 and lower end 108. The inner surface slopes inwardly from the upper end 106 to the lower end 108. Inward protrusion 110 is disposed between the upper end and the lower end. The inward protrusion, in the embodiment shown, comprises an annular bump with a substantially hemispherical cross-sectional configuration. Of course, other configurations are contemplated. The inward protrusion helps to direct the probe toward the valve opening 104, and provides an addition measure of strength to the sidewall to preclude damage to the sealing membrane during insertion of the probe.

The outer surface 98 of the sidewall structure 92 includes upper end 114 and lower end 116. Generally the outer surface is substantially perpendicular to the base wall structure 94. In the embodiment shown, the outer surface 98 substantially tracks the membrane engaging flange 66 in a spaced apart orientation therefrom, and in particular, the outer surface 98 is inclined slightly inwardly. The lower end 116 of the outer surface 98 may include a chamfer 99 which substantially matches the surface variation of the membrane engaging flange 66.

The sidewall structure 92 has a greater thickness at the lower end 108, 116 of the inner surface 96 and the outer surface 98, respectively, than at the upper ends thereof. As such, deformation of the lower end of the sidewall structure is minimized relative to the top thereof, and the additional thickness provides further cushioning if the probe is inserted in a manner that is not directed at the valve opening 104.

With reference to FIGS. 7 through 9, the base wall structure 94 includes inner surface 100, outer surface 102 and valve opening 104. The inner surface 100 is spaced apart from the outer surface such that the base wall structure 94 is of a substantially uniform thickness inboard of the sidewall structure 92.

The valve opening 104 comprises a plurality of slits that are configured to separate and to sealingly engage a probe inserted therethrough. Typically, with the materials that are contemplated for the sealing membrane, upon removal of the probe, the material rejoins such that the slits substantially preclude the passage therethrough of fluid. In the embodiment shown, a substantially snowflake like configuration is shown, which is well suited to the grasping and sealingly engaging a probe of, for example, a cylindrical configuration.

The connector region 120 is shown in FIG. 6 as comprising an inner interface 122 and an outer interface 124. The inner interface 122 engages the sidewall structure 92 of the valve body 90. The outer interface 124 extends from the sealing membrane, and in particular from the connector coupling interface 78. The outer interface 124 is spaced apart from the lower end of the lower seal surface 74 so as to form a channel which insures that contact of the connector region with the membrane engaging flange can be minimized.

With reference to FIG. 6, retaining ring 44 comprises a hoop-like structure which has body engaging tab 180, sealing membrane engagement surface 182 and inner wall structure 184. The tab 180 is shown as comprising a projection extending outwardly about the outside perimeter of the retaining ring.

The tab 180 is configured to be insertable and restrainable within the recessed channel 67. With the tab inserted within the channel 67, the body attachment flange 70 of the sealing membrane 42 becomes compressed so as to form a fluid-tight seal between the lower seal surface 76 of the sealing membrane 42 and the membrane engagement flange 66 of opening 54. In particular, the ring presses against the membrane so that its base surface presses against the body attachment flange and the upper seal surface 72 engages the seal membrane engagement surface 182. The natural resilience of the sealing membrane allows for the sealed engagement against the ring and the body. Typically, the seal membrane engagement surface includes a surface area which engages a similarly configured surface area on the membrane itself. The surface area of engagement is such that a significant seal can be created therebetween.

The inner wall structure 184 is configured to preclude damage to the membrane proximate the engagement of the membrane with the membrane engagement flange 66. Typically, the bags associated with the present cap assembly, when full, may have a weight of, for example 25 pounds or the like. As such, when dropped onto a probe-type dispenser that is designed to extend through the membrane, damage to the membrane is of heightened concern. It has been found that the potential for damage to the membrane is greatly reduced with the presently configured inner wall structure 184. The inner wall structure 184 includes a inwardly sloping protective flange 186 that extends over a portion of the membrane and extends radially inwardly beyond the inward projection of the membrane engagement flange 66. The inwardly sloping protective flange terminates with a substantially planar wall 187 which is substantially parallel to a longitudinal axis of the opening.

In such a configuration, a downwardly projecting probe may hit the inner wall structure 184 which will direct the probe inwardly toward the membrane. As the probe is directed to the membrane, the engagement of the probe with the membrane occurs at a point that is spaced apart from the membrane engagement flange 66 and thus, an additional measure of give is observed. The inwardly sloping angle is configured to slope inwardly at an acute angle of approximately 20° to 50°, however, the invention is not limited thereto.

Furthermore, the configuration of the membrane enhances the ability to withstand impacts from the downwardly projecting probe. The sidewall structure and the connector region are configured to both deflect and to direct the probe toward the valve opening. In particular, the inner surface 96 is inclined inwardly to urge the probe toward the valve opening. Additionally, the lower portions of the sidewall structure have less deflection, due to the greater thickness to further urge the probe toward the valve opening. Further still, the greater thickness and the inward protrusion further provide additional protection to the membrane to promote the integrity of the membrane.

As set forth in FIG. 2, the cap is attached to the spout. Tube 202 is extended through the opening 54. Unlike that which is shown in FIG. 1, the sealing membrane is combined with the body. Advantageously, the container itself includes the sealing membrane which does not move relative thereto, as the sealing membrane is directly coupled and moves directly with the cap and spout. In addition, the sealing membrane and the cap assembly includes a number of structures which limit the damage thereto and leaking therefrom, even where the probe is not initially properly engaged therewith.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A cap assembly comprising:

a body having an opening extending therethrough and a spout engagement channel extending therearound, the opening having a top end and a bottom end, and including an inner surface having a recessed circumferential channel and a membrane engaging flange positioned proximate the recessed circumferential channel;

a sealing membrane covering the opening and including a body attachment flange, a valve body forming a substantially cup shaped configuration extending inwardly from the attachment flange and in a depending direction toward the bottom end of the opening, the valve body including a sidewall structure with an inner surface and an outer surface, and a base wall structure spanning the inner surface of the sidewall structure, the inner surface being angled inwardly towards the bottom end of the opening so that the thickness of the sidewall structure increases away from an upper end thereof, the base wall structure having a valve opening extending therethrough, and a connector region coupling the upper end of the valve body to the body attachment flange, the sealing membrane positioned upon the membrane engaging flange so that the body engaging flange and the membrane engaging flange are in overlying engagement, and an inward protrusion extending inwardly from the inner surface of the sidewall structure spaced apart from the upper end and a lower end thereof; and a retaining ring including a tab, a sealing membrane engagement surface and an inner wall structure opposite the sealing membrane engagement surface, the retaining ring positioned with the sealing membrane engagement surface in overlying engagement with the sealing membrane, whereupon extension of the tab into the recessed circumferential channel of the body releasably maintains said overlying engagement and biases the retaining ring against the membrane, wherein the inward protrusion extends radially inwardly beyond the inner wall structure of the retaining ring.

2. The cap assembly of claim 1 wherein the inner wall structure of the retaining ring extends radially inward beyond the body attachment flange of the sealing membrane.

3. The cap assembly of claim 2 wherein the inner wall structure of the retaining ring extends radially inward beyond the connector region of the sealing membrane.

4. The cap assembly of claim 1 wherein the sealing membrane comprises a substantially circular configuration, matching the opening of the body, the body attachment flange comprising a substantially annular configuration having a substantially triangular cross-sectional configuration.

5. The cap assembly of claim 4 wherein the inward protrusion comprises an annular bump.

6. The cap assembly of claim 4 wherein the outer surface of the sidewall structure is substantially uniformly spaced apart from a portion of the opening of the body substantially corresponding thereto.

7. The cap assembly of claim 4 wherein the valve opening comprises a substantially snowflake like pattern of slits extending therethrough.

8. The cap assembly of claim 1 wherein the base wall is substantially planar.

9. The cap assembly of claim 1 wherein the ring further includes an inwardly sloping protective flange which terminates with a substantially planar wall which is substantially parallel to a longitudinal axis of the opening.

10. The cap assembly of claim 1 further including a cap which is removably coupled to the body, the cap precluding access to the opening and the sealing membrane when the cap assembly is in operable engagement with a bag.

11. The cap assembly of claim 1 wherein the inner wall structure of the retaining ring includes an inwardly sloped surface.

12. The cap assembly of claim 1 wherein the inwardly sloped surface is inclined at an acute angle, and terminates with a substantially planar wall.

13. The cap assembly of claim 1 wherein the recessed circumferential groove is spaced apart from a top surface of the cap.

14. The cap assembly of claim 1 wherein the opening further includes an upper inwardly sloping wall portion positioned above the recessed circumferential channel.

15. The cap assembly of claim 14 wherein the opening further includes a lower inwardly sloping wall portion positioned below the membrane.

16. The cap assembly of claim 1 wherein the inward protrusion is spaced apart from the connector region.

17. The cap assembly of claim 1 wherein the inward protrusion comprises an annular bump which is spaced apart from the base wall structure.

* * * * *